United States Patent [19]

Nakajima

[11] 4,431,180

[45] Feb. 14, 1984

[54] ROLLER SUPPORTING ARRANGEMENT FOR ELECTROSTATIC COPYING APPARATUS

[75] Inventor: Tadanobu Nakajima, Nara, Japan

[73] Assignee: Mita Industrial Company Limited, Osaka, Japan

[21] Appl. No.: 302,354

[22] Filed: Sep. 15, 1981

[30] Foreign Application Priority Data

Sep. 22, 1980 [JP] Japan ..... 55-135086[U]

[51] Int. Cl.[3] ..... B65H 5/06

[52] U.S. Cl. ..... 271/274; 432/60; 198/782

[58] Field of Search ..... 271/273, 274, 272, 264, 271/200; 355/35 H; 198/782, 624; 432/60, 62

[56] References Cited

U.S. PATENT DOCUMENTS

| | | | |
|---|---|---|---|
| 2,965,374 | 12/1960 | Streeter | 271/274 |
| 3,291,466 | 12/1966 | Aser et al. | 432/62 |
| 3,411,771 | 11/1968 | Bahr et al. | 271/273 |
| 3,618,934 | 11/1971 | Germuska | 271/274 |
| 3,743,406 | 7/1973 | Komori et al. | 271/273 |
| 4,040,387 | 8/1977 | Washio et al. | 118/658 |
| 4,116,556 | 9/1978 | Tanaka et al. | 355/3 TR |
| 4,145,181 | 3/1979 | Edwards et al. | 271/274 |
| 4,341,458 | 7/1982 | Glasa et al. | 432/60 |

OTHER PUBLICATIONS

IBM Technical Disclosure Bulletin, vol. 19, no. 5, Oct. 1976, Williams et al.

IBM Technical disclosure Bulletin, vol. 20, no. 12, May 1978, Jenney et al.

IBM Technical Disclosure Bulletin, vol. 23, no. 6, Nov. 1980, Edwards et al.

*Primary Examiner*—Bruce H. Stoner, Jr.

*Assistant Examiner*—James E. Barlow

*Attorney, Agent, or Firm*—Wenderoth, Lind & Ponack

[57] ABSTRACT

A roller supporting arrangement for an electrostatic copying apparatus having a plurality of pairs of copy paper transport rollers spaced along a copy paper transport passage includes a support frame for supporting the lower rollers of the respective pairs of transport rollers. A support shaft is mounted horizontally to a copying apparatus housing, by which the support frame is rotatably supported. A device is provided for pushing up the support frame and for releasing the support frame from the push-up force to be turned downward about the support shaft. Since the lower rollers of the pairs of the rollers mounted at the copy paper sheet transport passage are connected pivotally to the support frame which is rotatable about the horizontal support shaft, it is easy to open the copy paper sheet transport passage when a copy paper is jammed in the copy paper sheet transport passage.

7 Claims, 8 Drawing Figures

ROLLER SUPPORTING ARRANGEMENT FOR ELECTROSTATIC COPYING APPARATUS

BACKGROUND OF THE INVENTION

1. Field of the Invention

The present invention relates to a roller supporting arrangement for an electrostatic copying apparatus.

2. Description of the Prior Art

In a conventional roller supporting arrangement for an electrostatic copying apparatus, several pairs of copy paper transport rollers are mounted along a copy paper sheet transport passage. Since the lower roller and upper roller of each pair are in contact with each other, and the rollers are fixed to a copying apparatus housing, it is difficult to take out a clogged copy paper sheet when a copy paper is jammed. It is an object of the present invention to provide a roller supporting arrangement where the copy paper sheet transport passage may be opened easily.

SUMMARY OF THE INVENTION

To accomplish the foregoing object, there is provided a roller supporting arrangement which comprises, a support frame for supporting the lower rollers of the respective pairs of transport rollers, a support shaft mounted horizontally to a copying apparatus housing, by which the support frame is rotatably supported, and means for pushing up to support the support frame pivotally supported by the support shaft, and for releasing the support frame from the push-up force to enable the support frame to turn downward about the support shaft.

Opposite ends of lower roller of a pair of fixing rollers mounted along the copy paper sheet transport passage are supported in a pair of upwardly elongated openings formed in opposite sides of the support frame, and the lower roller is upwardly spring-biased with spring fixed to the copying apparatus housing.

According to a preferred embodiment of the invention, one of the side walls of the support frame which is parallel to the copy paper transport direction is connected pivotally about an support shaft extending parallel to the copy paper transport direction. A lever having an axis extending along the copy paper transport direction is pivotally connected to the other side wall of the support frame, and the support frame is displaced so that the pairs of rollers may come into contact with each other when the lever is in a vertical position and an end of the lever comes into contact with the housing.

According to another preferred embodiment of the present invention, a first end wall of the support frame is pivotally connected to the copying apparatus housing about a support shaft which extends at a right angle to the copy paper transport direction. The support frame has a downwardly inclined surface formed from a second end wall toward the first end wall. The support frame is displaced when a lever is in a vertical position so that the pairs of rollers may come in contact with each other by means of an associating shaft mounted on the lever and having an axis extending at a right angle to the copy paper transport direction.

According to the present invention, since the lower rollers of the pairs of the rollers mounted along the copy paper sheet transport passage are connected to the support frame which is rotatable about a horizontal support shaft, it is easy to open the copy paper sheet transport passage when a copy paper is jammed in the copy paper transport passage.

BREIF DESCRIPTION OF THE DRAWINGS

A detailed description of the invention will be made with reference to the accompanying drawings, which are to scale. Like numerals designate correponding parts in the several figures.

DETAILED DESCRIPTION OF THE INVENTION

The present invention relates to a roller supporting arrangement for use in an electrostatic copying apparatus.

Figure 1:
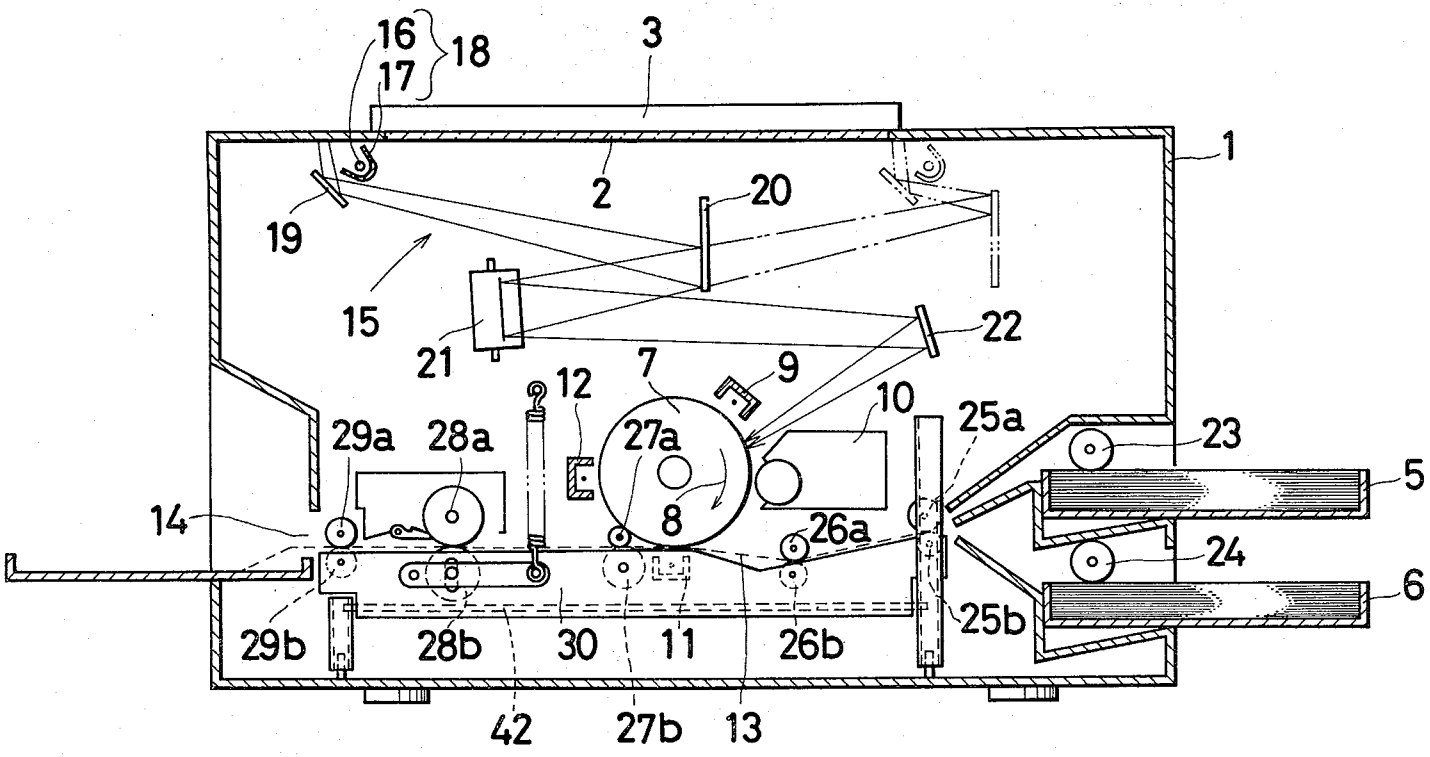
FIG. 1 is a schematic side sectional view according to one preferred embodiment of the present invention.

In FIG. 1, there is shown a schematic side sectional view of a copying apparatus according to one preferred embodiment of the present invention. The transfer type electrostatic copying apparatus of FIG. 1 is provided, at the upper portion of its housing 1, with a transparent platform or plate 2 on which an original to be copied (not particularly shown) is placed horizontally. Covering the surface of the transparent platform 2, there is provided an original presser plate 3 for bringing the original into pressure contact with transparent platform 2. Meanwhile, at one side of the apparatus housing 1, paper feeding cassettes 5 and 6 for supplying copy paper sheets are detachably mounted. In these paper feeding cassettes 5 and 6, copy paper sheets of different sizes are respectively accommodated.

At approximately the central portion of the apparatus housing 1, a photosensitive drum or photoreceptor drum 7 formed by providing a photosensitive layer on the outer periphery of a cylindrical base is rotatably mounted. Around the photoreceptor drum 7, there are sequentially disposed, along a rotational direction 8 thereof, a charging corona discharger 9 for electrically charging the photosensitive layer of the photoreceptor drum 7, a magnetic brush developing device 10 for developing an electrostatic latent image formed on the photosensitive layer of the drum 7 into a visible toner image, a transfer corona discharger 11 for transferring the toner image formed on the photosensitive layer onto a copy paper sheet, and an erasing corona discharger 12 for eliminating residual charge remaining on the photosensitive layer after the transfer.

At a position above the photoreceptor drum 7, an optical device 15 is provided so as to form the image of the original on the photoreceptor drum 7. The optical device 15 includes a light projecting means 18 having an exposure lamp 16 and a reflecting wall 17 for projecting light onto the original through the transparent platform 2, movable reflecting mirrors 19 and 20 for further reflecting the light projected to the original and reflected thereby, an in-mirror lens 21 for reflecting and condensing the light reflected by movable reflecting mirrors 19 and 20, and also another reflecting mirror 22 to reflect the light condensed by the in-mirror lens 21 for projection thereof onto the photoreceptor drum 7. In positions above the forward ends of the copy paper feeding cassettes 5 and 6, corresponding paper feeding rollers 23 and 24 are respectively provided. The copy paper sheets supplied from the paper feeding rollers 23 and 24 are fed in so as to closely contact the photosensitive layer of the photoreceptor drum 7 which confronts the transfer corona discharger 11, along a copy paper sheet transport passage 13, indicated by a dotted line, sequentially through a pair of upper and lower transport rollers 25*a* and 25*b* and another pair of upper and lower feeding transparent rollers 26*a* and 26*b*. After completion of the transfer, the copy paper sheet is held, at its one edge in the widthwise direction thereof, between a pair of upper and lower peel-off or separating rollers 27*a* and 27*b* so as to be separated from the photoreceptor drum 7, and is further forwarded toward a pair of upper and lower fixing rollers 28*a* and 28*b*. After the toner image on the copy paper sheet is fixed under pressure by the above fixing rollers 28*a* and 28*b*, the copy paper sheet is discharged out of a discharge outlet 14 by a pair of upper and lower discharge rollers 29*a* and 29*b* to complete one copying cycle.

Figure 2:
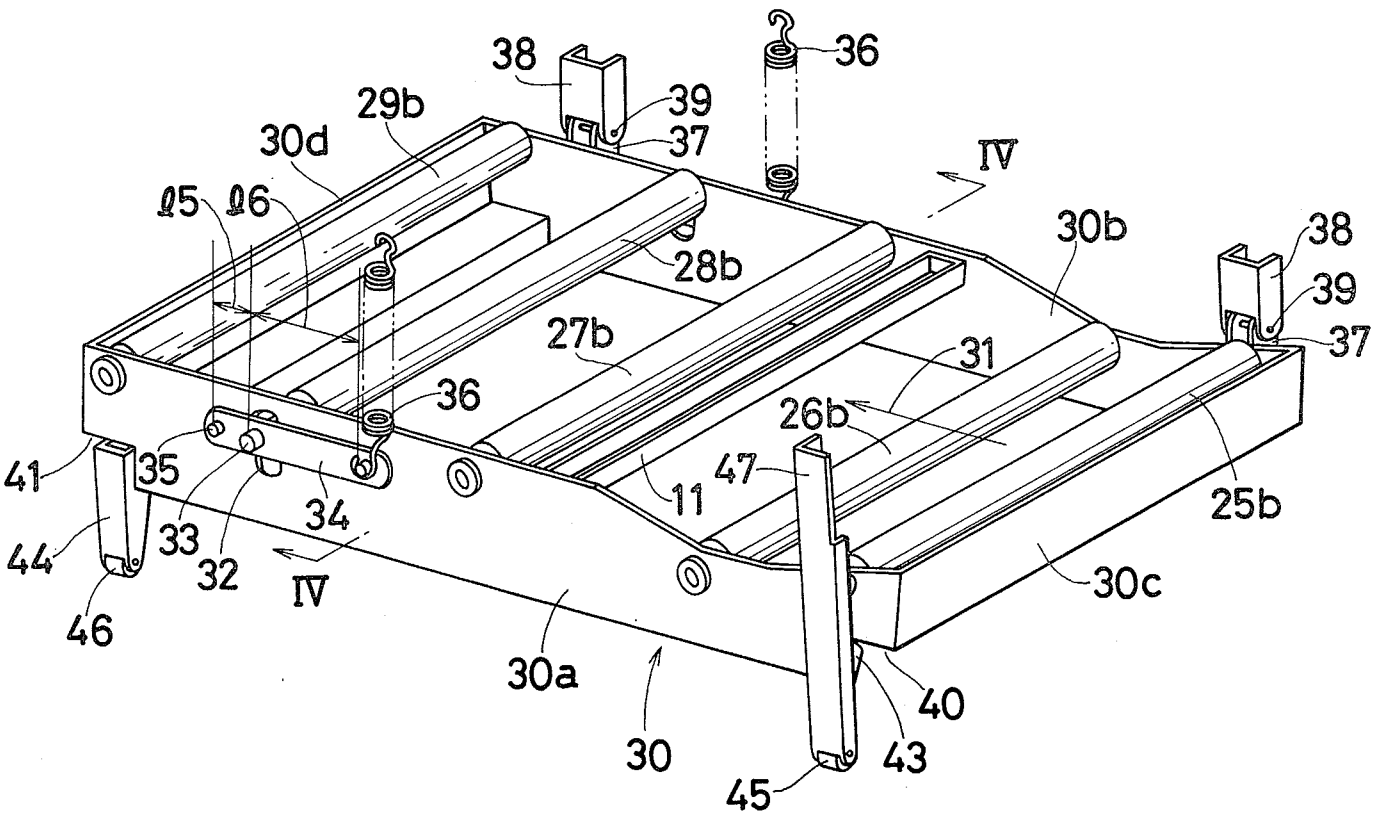
FIG. 2 is a perspective view of a support frame in the embodiment of FIG. 1.

Of the respective rollers constituting the copy paper transport passage 13, the rollers 25*b*, 26*b*, 27*b*, 28*b* and 29*b*, and also, the transfer corona discharger 11 are supported by a support frame 30 as shown in FIG. 2. It is to be noted that in FIG. 2, guide plates to be disposed between the respective rollers are omitted for brevity. The support frame 30 as described above is basically constituted by opposite side walls 30*a* and 30*b* provided along the direction 31 for transportation of the copy paper sheets, and end walls 30*c* and 30*d* connecting respective end portions of the side walls 30*a* and 30*b*. The rollers 25*b*, 26*b*, 27*b* and 29*b* are rotatably journalled in opposite side walls 30*a* and 30*b* of the support frame 30. In positions corresponding to the opposite ends of the fixing roller 28*b*, vertically extending elongated openings 32 are formed in the side walls 30*a* and 30*b*, while the opposite ends of a shaft 33 for the fixing roller 28*b* are extended through elongated openings 32 so as to be vertically displaceable within the openings 32. In positions still outside the side walls 30*a* and 30*b*, the opposite ends of the shaft 33 are respectively fixed to intermediate portions of corresponding levers 34. At the downstream side of the elongated openings 32 along the transport direction 31, each of the side walls 30*a* and 30*b* is provided with a pin 35 projecting outwardly therefrom and directed in a direction parallel to the shaft 33; while one end of each of levers 34 is pivotally supported by the pin 35. To the other ends of the lever 34, lower ends of vertically extending springs 36 are respectively connected, with upper ends of springs 36 being each connected to the apparatus housing 1. Accordingly, each of the levers 34 is urged counterclockwise in FIG. 2 about the respective pin 35 by the spring force of the respective spring 36, and consequently, the shaft 33 and the fixing roller 28*b* are urged upwardly, and thus, the fixing roller 28*b* is held in pressure contact with the counterpart fixing roller 28*a*.

Figure 3:
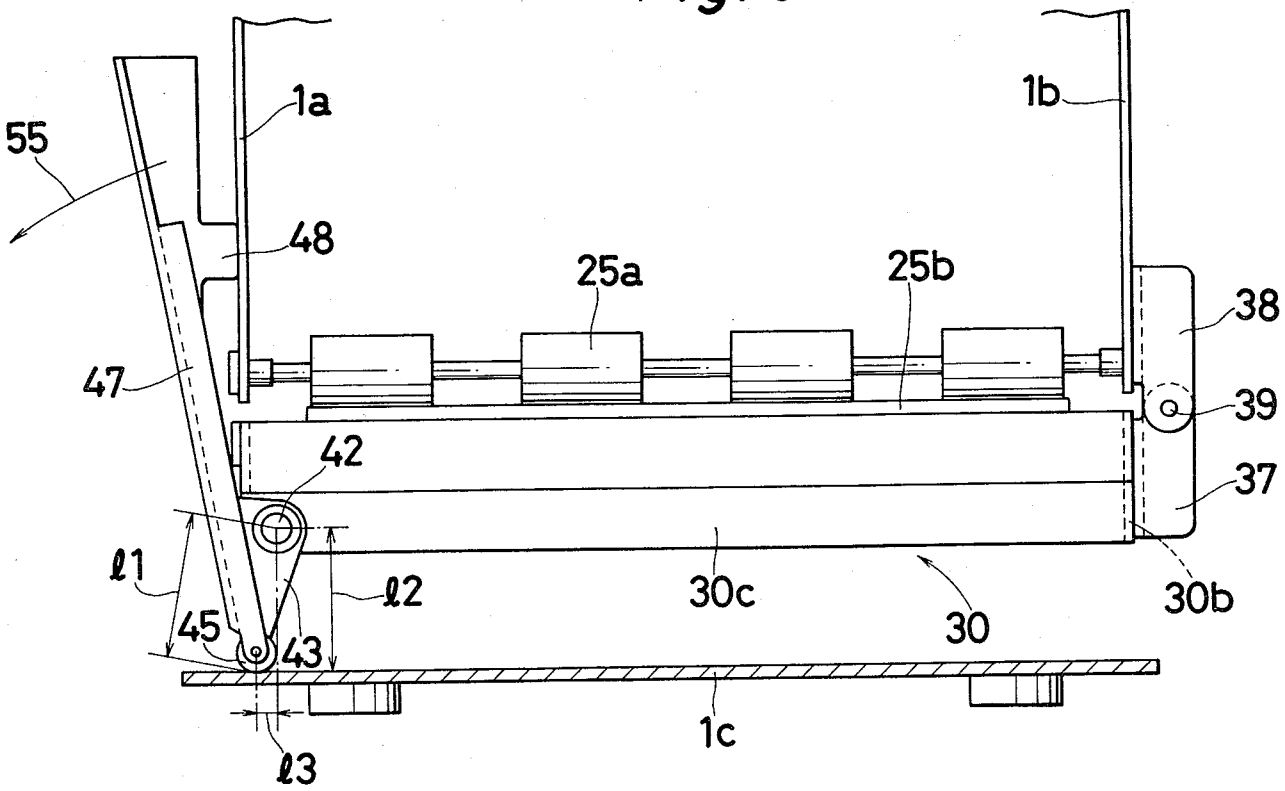
FIG. 3 is a right side view of the support frame of FIG. 2.

FIG. 3 is the right side elevational view of the support frame arrangement of FIG. 2. To one side wall 30*b* of the support frame 30 and to a side wall 1*b* of the apparatus housing 1 corresponding to side wall 30*b*, connecting pieces 37 and 38 are respectively secured, while these connecting pieces 37 and 38 are connected to each other through a support shaft 39 directed along the transport direction 31 of the copy paper sheet. Accordingly, the support frame 30 may be turned or opened downwardly through rotation in the counterclockwise direction about the support shaft 39 in FIG. 3.

At opposite ends of the support frame 30 along the copy paper sheet transport direction 31, the upper portions of the side walls 30*a* and 30*b* are further projected from the lower portions thereof, i.e. in lateral directions as shown in FIGS. 1 and 2 for rotatably supporting the rollers 25*b* and 29*b*. End walls 30*c* and 30*d* are respectively provided to connect corresponding end edges of the side walls 30*a* and 30*b* to each other, and therefore, spaces 40 and 41 are respectively formed at the lower portions of the opposite ends of the support frame 30. Along the lower inner face of the side wall 30*a*, there is provided an associating shaft 42 directed in a direction parallel to the support shaft 39. Opposite ends of associating shaft 42 rotatably extend through the end walls 30*c* and 30*d* into the spaces 40 and 41. The opposite ends of the above associating shaft 42 are fixed to corresponding upper ends of leg members 43 and 44. On the other ends (i.e. lower ends in FIG. 3) of the leg members 43 and 44, rolls or wheels 45 and 46 each having a rotary axis parallel to the axis of the associating shaft 42 are rotatably mounted respectively. The distance l1 from the axis of the associating shaft 42 to the lower faces of the rolls 45 and 46 is selected to be longer than a distance l2 from the axis of the associating shaft 42 to the bottom portion 1*c* of the apparatus housing 1 in the state where the respective pairs of rollers for the copy paper sheet transport passage 13 are brought into pressure contact to each other under a proper pressure.

The one leg member 43 is integrally formed with a control or operating lever 47 extending upwardly along the outer surface of the side wall 30*a*. The control lever 47 as described above is provided with a stopper piece 48 projecting therefrom so as to contact a side wall 1*a* of the apparatus housing to prevent further rotation, when the respective pairs of rollers are brought into pressure contact through rotation of the support frame 30 about the support shaft 39 in the clockwise direction.

Figure 4:
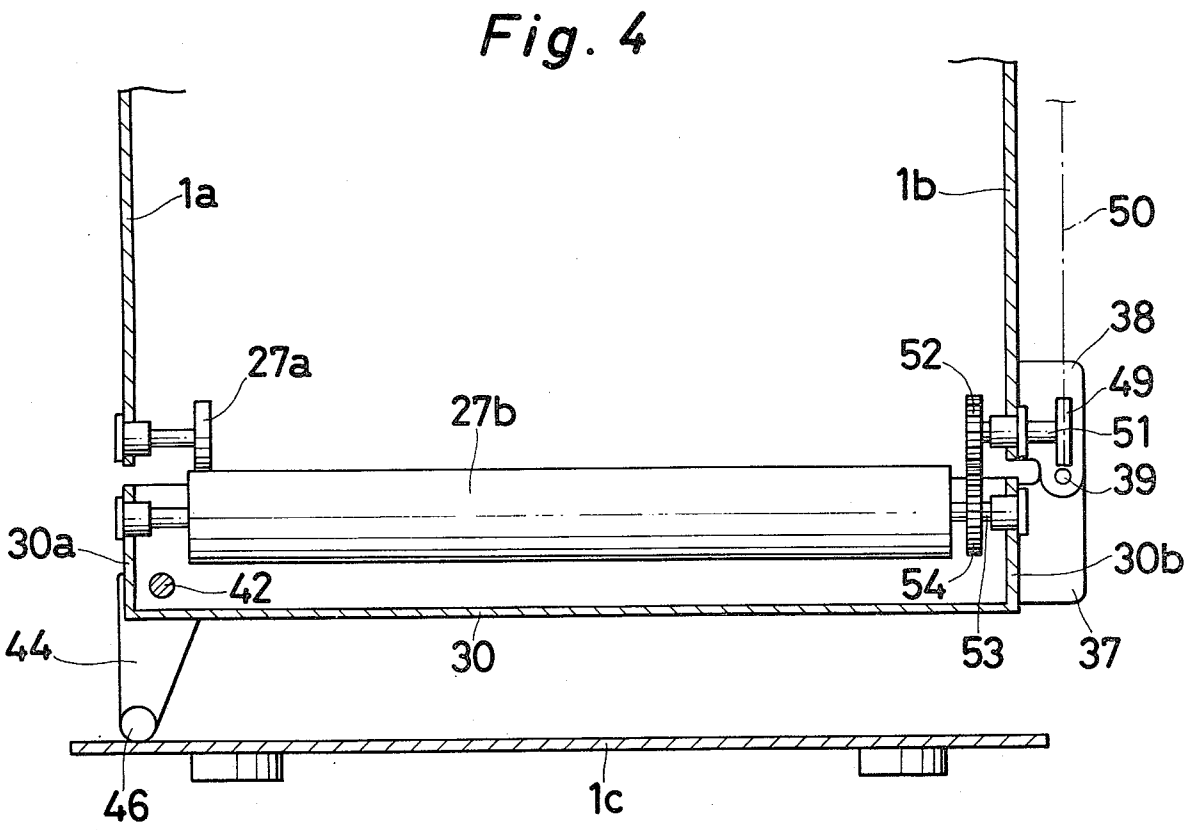
FIG. 4 is a cross sectional view taken along the line IV—IV of FIG. 2.

Referring to FIG. 4 showing a cross section taken along the line IV—IV of FIG. 2, the respective rollers 25*b*, 26*b*, 28*b* and 29*b* rotatably supported by the support frame 30 are follower rollers, and the corresponding upper rollers 25*a*, 26*a*, 28*a* and 29*a* are driven for rotation by driving force imparted from a driving source (not shown). The follower rollers 25*b*, 26*b*, 28*b* and 29*b* are rotated when they are held in pressure contact with the driving rollers 25*a*, 26*a*, 28*a* and 29*a*. To a rotary shaft 53 of the separating roller 27*b*, a gear 54 is fixedly mounted in an inner position with respect to the side wall 30*b* remote from the side wall for the separating roller 27*a*. Meanwhile, in the side wall 1*b* of the apparatus housing 1, a rotary shaft 51 parallel to the rotary shaft 53 is journalled, with a gear 52 which engages the gear 54 being fixed to rotary shaft 51. In an outer position with respect to the side wall 1*b*, a sprocket wheel 49 is fixedly mounted on the rotary shaft 51 so as to receive driving force from the driving source (not shown) through a chain 50 passed around sprocket 49. Accordingly, the driving force from the driving source is transmitted to the lower separating roller 27*b* through the gears 52 and 54, and the other separating roller 27*a* held in pressure contact with the separating roller 27*b* is consequently rotated. By the above arrangement, the gears 52 and 54 are disengaged upon rotation of the support frame 30 downward about the support shaft 39, while, when the support frame 30 is turned upward about the support shaft 39 and then, returned to the original position, the gears 52 and 54 are readily connected to each other. It is to be noted here that the gears 52 and 54 are not required to be necessarily provided at the inner positions with respect to the side walls 1*b* and 30*b*, but merely need be disposed at inner sides with respect to the support shaft 39.

On the assumption that paper jamming has taken place in the copy paper transport passage 13, the control lever 47 is held by hand, in this case, for rotation in the direction indicated by an arrow 55 in FIG. 3. In the course of the above operation for rotation, the support frame 30 is pushed up in the clockwise direction in FIG. 3 about the support shaft 39 until the rolls 45 and 46 pass through the vertical plane including the axis of the associating shaft 42. Thereafter, when the rolls 45 and 46 have passed through such vertical plane, the support frame 30 is rotated in the counterclockwise direction about the support shaft 39 as shown in FIG. 5, and thus, the left side in FIG. 5 is opened, and therefore, the copy paper sheet 56 jammed in the copy paper sheet transport passage 13 may be taken out or removed extremely easily.

Furthermore, in the course of rotating the support frame 30 about the support shaft 39 for opening the copy paper sheet transport passage 13, since one end of each lever 34 is connected to the respective spring 36, the lever 34 is rotated about the respective pin 35, and the shaft 33 is brought into contact with the upper portion of the elongated opening 32. Therefore, there is no possibility that the support frame 30 is rapidly rotated about the support shaft 39 falls by its own weight in the course of the rotating operation. Accordingly, the danger that an operator's hand is accidentally held between the support frame 30 and the bottom portion 1*c* of the apparatus housing 1 is fully avoided, while any damage to the support frame 30 due to application of a strong impact thereto by a sudden falling may also be prevented advantageously.

Figure 5:
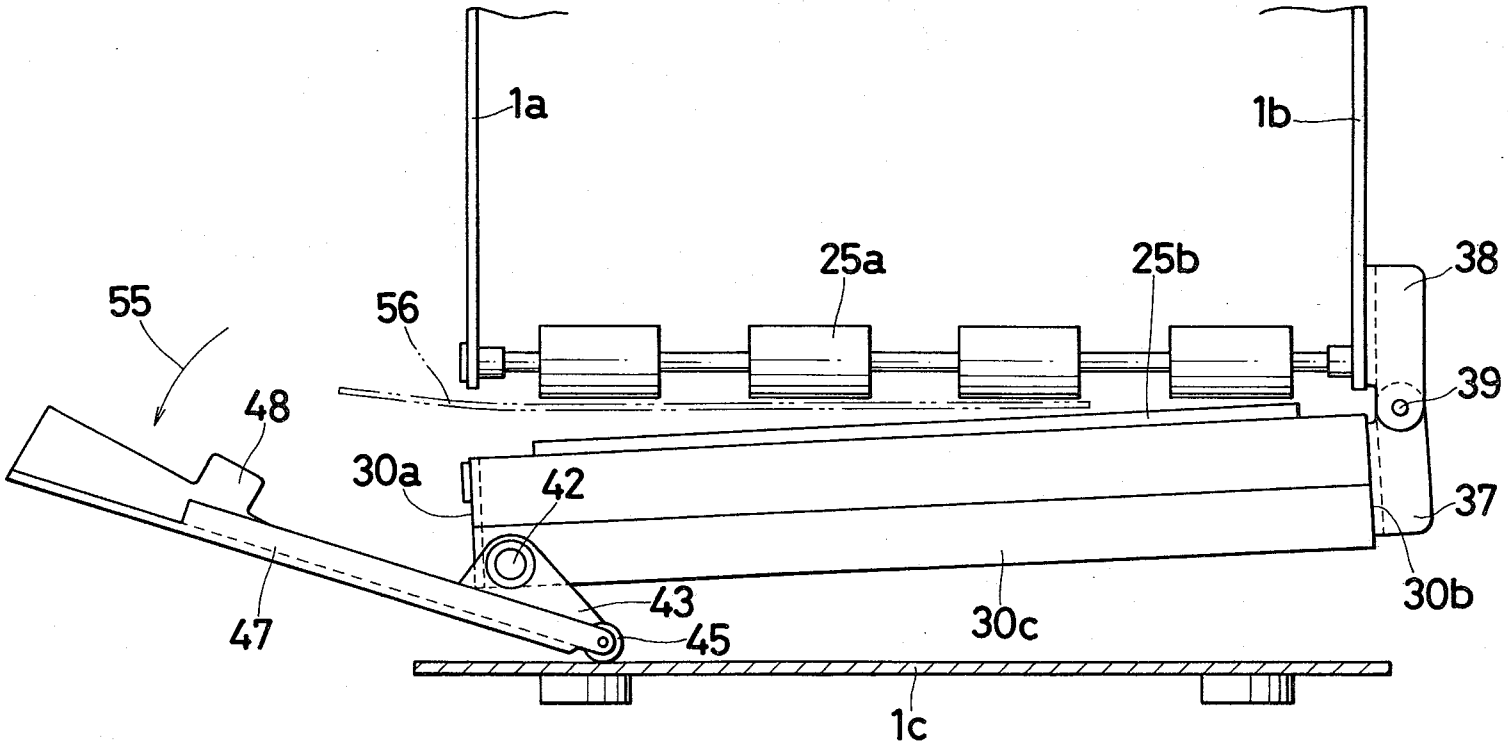
FIG. 5 is a side view of the support frame of FIG. 3 being rotated downwardly.

After having removed the jammed copy paper sheet from the copy paper sheet transport passage 13, the control lever 47 is raised or turned in the clockwise direction in FIG. 5 about the associated shaft 42, whereby the rolls 45 and 46 of the leg members 43 and 44 are rotated in the clockwise direction in FIG. 5 about the associating shaft 42 while contacting the bottom portion 1*c*, with corresponding rotation of the support frame 30 about the support shaft 39 in the clockwise direction in FIG. 5. In the above rotating operation by the control lever 47, since the opposite ends of the shaft 33 are brought into contact with the upper portions of the elongated openings 32, and the support frame 30 is urged upwardly by the spring 36, it is possible to turn the support frame 30 upwardly by means of a comparatively small force.

It should be noted here that the spring force of the springs which define the force of the pressure contact between the roller 28 and fixing roller 28*a* may be varied by adjusting the ratio of a distance l5 between the pin 35 and the shaft 33 to a distance l6 (FIG. 2) between a connecting position of the spring 36 to the lever 34 and the shaft 33.

The leg members 43 and 44 are operated for rotation by the control lever 47 until the rolls 45 and 46 thereof are located on a side opposite to the support shaft 39 with respect to the vertical plane including the axis of the associating shaft 42. The control lever 47 is prevented from further rotation by the contact of the stopper piece 48 thereof with the side wall 1*a*. In the operated state for rotation as described above, the respective pairs of rollers 25*a* and 25*b*, 26*a* and 26*b*, 27*a* and 27*b*, 28*a* and 28*b*, and 29*a* and 29*b* for the copy paper sheet transport passage 13 are held in pressure contact with each other under a proper force. Furthermore, since the rolls 45 and 46 are located at the side remote from the support shaft 39 with respect to the associating shaft 42 by a distance l3, for example about 2 mm, there is no possibility that the support frame 30 will be rotated about the support shaft 39 by its weight.

Figure 6:
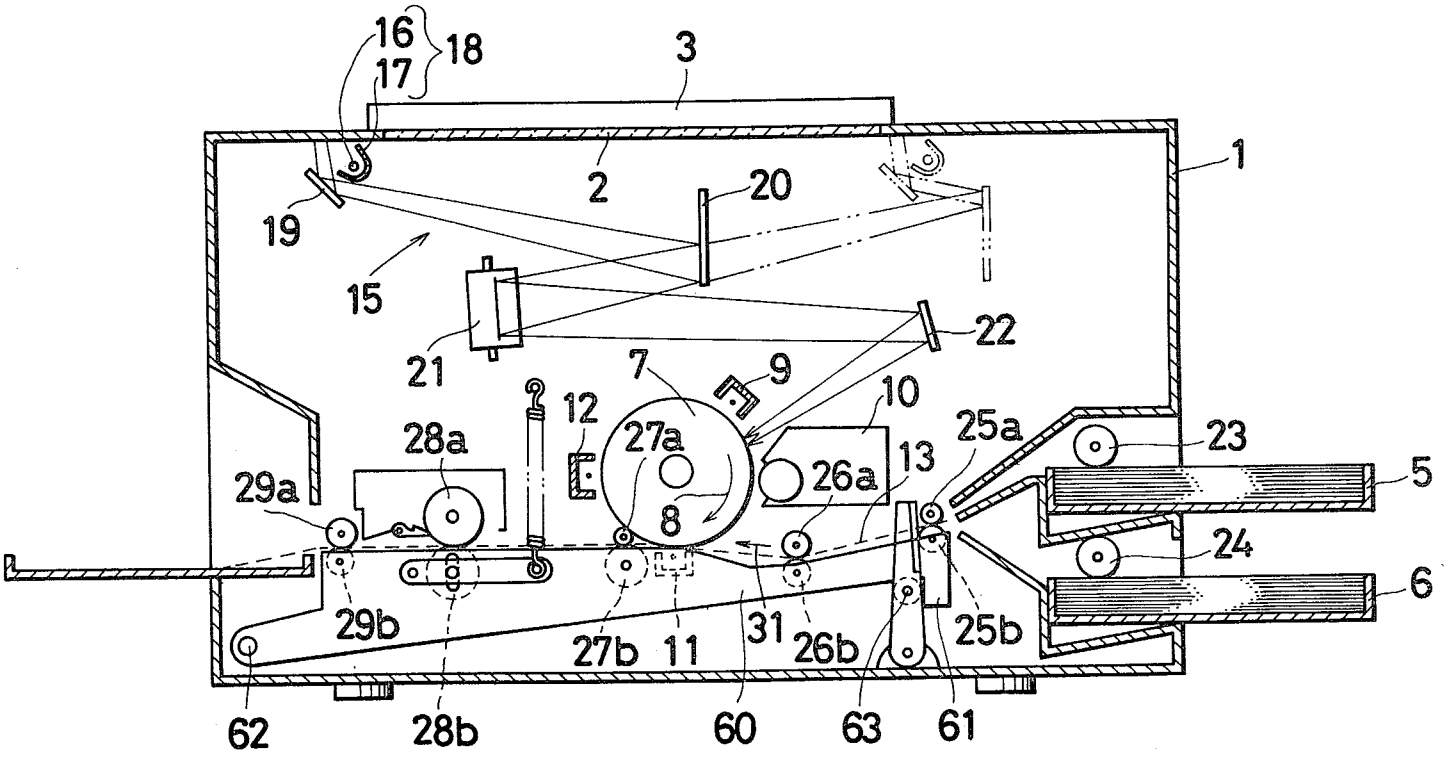
FIG. 6 is a schematic side sectional view according to another preferred embodiment of the present invention.

Reference is made to FIG. 6 showing a schematic side sectional view of an electrostatic copying apparatus according to another embodiment of the present invention, in which like parts corresponding to those in the embodiment of FIGS. 1 to 5 are designated by like reference numerals.

In the arrangement of FIG. 6, the respective rollers 25*b*, 26*b*, 27*b*, 28*b* and 29*b* for the copy paper sheet transport passage 13 are rotatably supported by a support frame 60, while the transfer corona discharger 11 is secured to support frame 60. In the above embodiment, in the end portion at the downstream side along the copy paper sheet transport direction 31, the support frame 60 is pivotally connected to the apparatus housing 1 for rotation about a horizontal axis directed at right angles with respect to the copy paper sheet transport direction 31.

Figure 7:
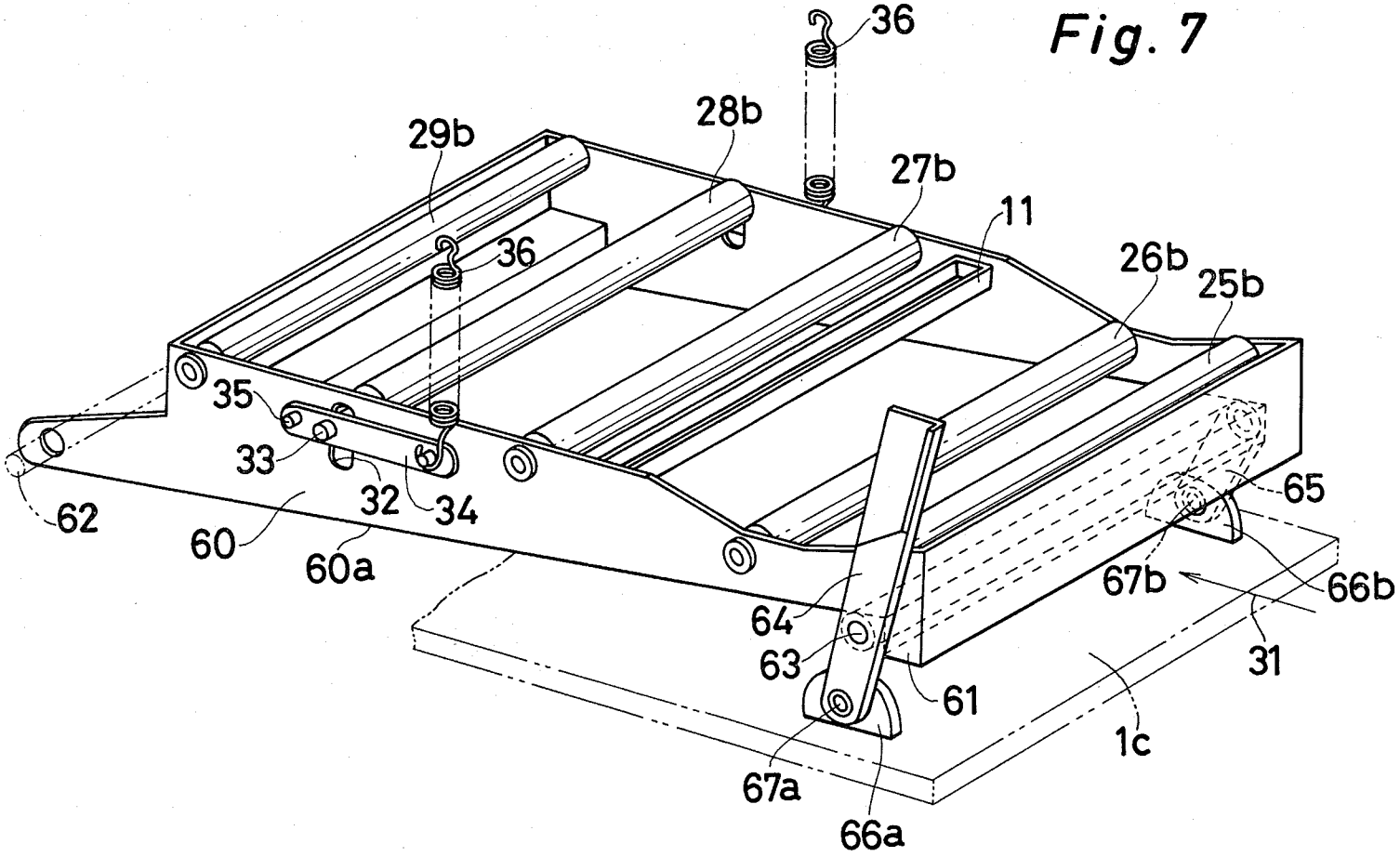
FIG. 7 is a perspective view of a support frame of the embodiment of FIG. 6.

In FIG. 7 showing a perspective view of the support frame 60, and inclined surface 60*a* of the support frame 60 is formed to be tapered downwardly toward the copy paper sheet transport direction 31, and in the end portion at the upstream side along the copy paper sheet transport direction 31, there is provided a stopper projection 61 protruding downwardly from the inclined surface 60*a*. Meanwhile, at the downstream side of the copy paper sheet transport direction 31, the apparatus housing 1 is provided with a horizontal support shaft 62 directed at right angles with respect to transport direction 31, and the support frame 60 is pivotally supported by support shaft 62.

Figure 8:
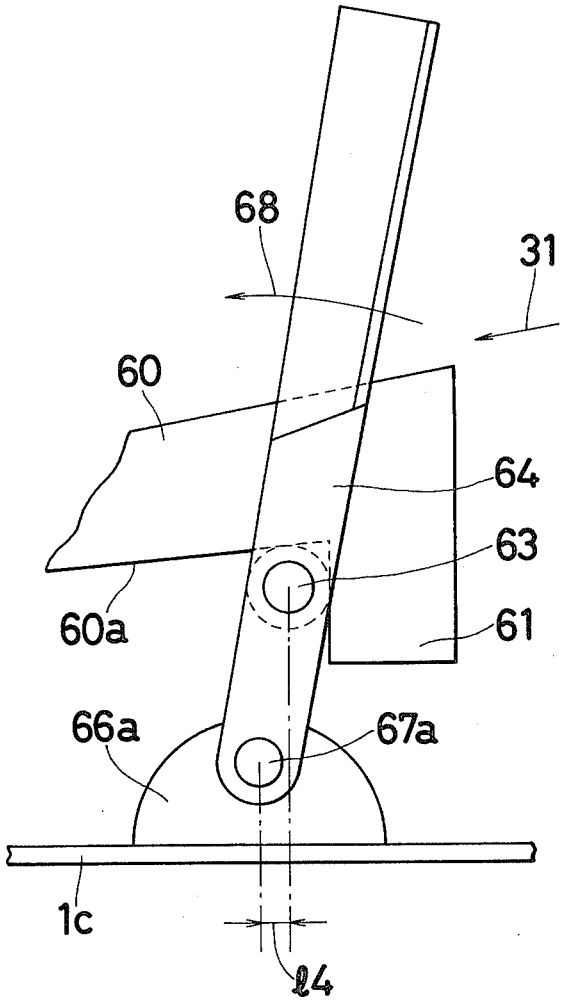
FIG. 8 is a front elevational view of a support projection of the support frame of FIG. 6.

Referring further to FIG. 8 showing, on an enlarged scale, the front elevational view in the vicinity of the stopper projection 61 of the support frame 60, in the lower end portion of the support frame 60 at the upstream side along the copy paper sheet transport directional 31, a horizontal associating shaft 63 directed at right angles with respect to transport direction 31 is provied to extend over the entire width of the support frame 60. One end of the above associating shaft 63 is pivotally supported in an upwardly extending control lever 64. Meanwhile, the other end of the associating shaft 63 is pivotally supported by the upper end portion of a upwardly extending leg member 65. The lower ends of the control lever 64 and leg member 65 are also pivotally connected to corresponding brackets 66*a* and 66*b* provided at the bottom portion 1*c* of the apparatus housing 1 through pins 67*a* and 67*b* directed in a direction parallel to the associating shaft 63. Under the state where the associating shaft 63 contacts the under face of the inclined surface 60*a*, with the associating shaft 63 engaging the stopper projection 61, the respective pairs of rollers for the copy paper sheet transport passage 13 are held in pressure contact at a proper force.

In the state where the associating shaft 63 is brought into contact with the stopper projection 61, the axis of the associating shaft 63 is located closer to the upstream side along the transport derection 31 than the axis of the pins 67*a* and 67*b* by a distance l4, whereby undesirable rotation of the associating shaft 63 about the pins 67*a* and 67*b* due to the weight of the support frame 60 in the counterclockwise direction in FIG. 8, is advantageously prevented.

According to the embodiment of FIGS. 6 through 8, by turning the control lever 64 for operation about the pins 67*a* and 67*b* in the direction of the arrow 68, the support frame 60 is rotated about the support shaft 62 in the clockwise direction of FIG. 6. Accordingly, when copy paper jamming has taken place in the copy paper sheet transport passage 13, transport passage 13 may readily be opened, and thus, the copy paper sheet clogged in the copy paper sheet transport passage 13 can be easily removed.

According to another aspect of the present invention, the control lever 47 may be mounted at about the central position of the side wall 30*a*, while the leg member may be omitted.

What is claimed is:

1. A roller supporting apparatus for use in an electrostatic copying apparatus of the type including an apparatus housing, a pair of fixing rollers, and a plurality of pairs of transport rollers, with the pair of fixing rollers and the pairs of transport rollers being spaced along a copy paper transport passage, said apparatus comprising:

a support frame for supporting a lower roller of the pair of fixing rollers and lower rollers of the pairs of transport rollers, said support frame having first and second spaced side walls extending parallel to the direction of copy paper transport along the copy paper transport passage and spaced end walls extending at right angles to said side walls, and said side walls having therein vertically elongated openings for supporting opposite ends of the lower fixing roller;

means, connected to said side walls and adapted to be connected to the apparatus housing, for spring-biasing upwardly the lower fixing roller supported within said openings;

a horizontal support shaft extending parallel to said copy paper transport direction and pivotally connected to said first side wall for pivotally mounting said support frame to the apparatus housing; and means for selectively pushing said support frame upwardly about said support shaft to an operative position, whereat the lower fixing and transport rollers are in contact with the respective upper fixing and transport rollers, and for displacing said support frame downwardly about said support shaft to an opened position, whereat the lower rollers are spaced from the upper rollers, said pushing and displacing means comprising a control lever pivotally connected to said second side wall about an axis extending parallel to said copy paper transport direction, said control lever being pivotal about said axis between a first position whereat said support frame is at said operative position and a second position whereat said support frame is at said opened position.

2. An apparatus as claimed in claim 1, wherein said control lever includes a stopper adapted to abut the apparatus housing to limit movement of said control lever to said first position thereof.

3. An apparatus as claimed in claim 1, wherein said axis comprises a shaft pivotally mounted in said end walls, and said pushing and displacing means comprises a leg member having an upper end fixed to said shaft and a lower end carrying a roll adapted to contact the apparatus housing when said control lever is in said first position thereof, said control lever being fixed to said leg member.

4. An apparatus as claimed in claim 3, wherein said leg member and said control lever are positioned adjacent a first said end wall, and further comprising an additional leg member fixed to said shaft and positioned adjacent a second said end wall.

5. An apparatus as claimed in claim 1, wherein said spring-biasing means comprises, on each said side wall, a pin projecting outwardly from the respective said side wall, a lever pivoted at a first end thereof to said pin, a spring having a lower end connected to a second end of said lever and an upper end adapted to be connected to the apparatus housing, thereby biasing said lever upwardly about said pin, and an intermediate portion of said lever adapted to be connected to the lower fixing roller.

6. A roller supporting apparatus for use in an electrostatic copying apparatus of the type including an apparatus housing, a pair of fixing rollers, and a plurality of pairs of transport rollers, with the pair of fixing rollers and the pairs of transport rollers being spaced along a copy paper transport passage, said apparatus comprising:

a support frame for supporting a lower roller of the pair of fixing rollers and lower rollers of the pairs of transport rollers, said support frame including spaced side walls extending parallel to the direction of copy paper transport along the copy paper transport passage, first and second end walls extending at right angles to said side walls, a bottom portion having a surface inclined downwardly toward said first end wall from said second end wall in said copy paper transport direction, a stopper projection extending downwardly from said inclined surface at a position at the upstream end of said bottom portion with respect to said copy paper transport direction, and said side walls having therein vertically elongated openings for supporting opposite ends of the lower fixing roller;

means, connected to said side walls and adapted to be connected to the apparatus housing, for spring-biasing upwardly the lower fixing roller supported within said openings;

a horizontal support shaft extending transverse to said copy paper transport direction and pivotally connected to a downstream end of said support frame adjacent said first end wall with respect to said copy paper transport direction for pivotally mounting said support frame to the apparatus housing; and means for selectively pushing said support frame upwardly about said support shaft to an operative position, whereat the lower fixing and transport rollers are in contact with the respective upper fixing and transport rollers, and for displacing said support frame downwardly about said support shaft to an opened position, whereat the lower rollers are spaced from the upper rollers, said pushing and displacing means comprising a bracket adapted to be fixed to a lower portion of the apparatus housing, a control lever having a lower end pivotally connected to said bracket about a pin extending transverse to said copy paper transport direction and an upper end, and a shaft pivotally connected to said control lever at a position between said lower and upper ends thereof and extending parallel to said pin over the entire width of said support frame, said shaft, when said support frame is in said operative position, contacting said inclined surface and said stopper projection.

7. An apparatus as claimed in claim 6, wherein said spring-biasing means comprises, on each said side wall, a pin projecting outwardly from the respective said side wall, a lever pivoted at a first end thereof to said pin, a spring having a lower end connected to a second end of said lever and an upper end adapted to be connected to the apparatus housing, thereby biasing said lever upwardly about said pin, and an intermediate portion of said lever adapted to be connected to the lower fixing roller.

* * * * *